United States Patent [19]

Shimoyama et al.

[11] Patent Number: 4,560,423

[45] Date of Patent: Dec. 24, 1985

[54] PROCESS FOR PRODUCING A NON-ORIENTED ELECTROMAGNETIC STEEL SHEET HAVING EXCELLENT MAGNETIC PROPERTIES

[75] Inventors: Yoshiaki Shimoyama; Kunisuke Miyoshi; Yoshitaka Hiromae, all of Kitakyushu, Japan

[73] Assignee: Nippon Steel Corporation, Tokyo, Japan

[21] Appl. No.: 486,949

[22] PCT Filed: Aug. 28, 1981

[86] PCT No.: PCT/JP81/00202

§ 371 Date: Mar. 15, 1983

§ 102(e) Date: Mar. 15, 1983

[87] PCT Pub. No.: WO83/00506

PCT Pub. Date: Feb. 17, 1983

[30] Foreign Application Priority Data

Aug. 5, 1981 [JP] Japan ..... 56-122731

[51] Int. Cl.[4] ..... H01F 1/04

[52] U.S. Cl. ..... 148/111; 148/31.55

[58] Field of Search ..... 148/110, 111, 112

[56] References Cited

U.S. PATENT DOCUMENTS

| | | | |
|---|---|---|---|
| 3,203,839 | 8/1965 | Takahashi | 148/111 |
| 3,935,038 | 1/1976 | Shimoyama et al. | 148/111 |
| 3,948,691 | 4/1976 | Matsushita et al. | 148/111 |
| 4,204,890 | 5/1980 | Irie et al. | 148/111 |

FOREIGN PATENT DOCUMENTS

| | | |
|---|---|---|
| 53-66816 | 6/1978 | Japan . |
| 55-97426 | 7/1980 | Japan . |

*Primary Examiner*—John P. Sheehan

*Attorney, Agent, or Firm*—Kenyon & Kenyon

[57] ABSTRACT

The present invention relates to a process for producing a non-oriented silicon steel sheet having a low watt loss and an improved magnetic flux density. Generally, increasing the content of silicon and aluminum in a steel reduces the watt loss of the final product but deteriorates the magnetic flux density. Also, increasing the finishing temperature of a steel sheet or to increase the size of the crystal grains of the final product reduces the watt loss of the final product but also decreases the magnetic flux density.

In accordance with the present invention, a grade S7 or grade S8 non-oriented electromagnetic steel sheet exhibiting such excellent magnetic properties at a high magnetic field that the magnetic flux density $B_{50}$ is 1.67 tesla or more, the watt loss $W_{15/50}$ is 2.70 W/kg or less (0.50 mm thick), and the watt loss $W_{15/50}$ is 2.20 W/kg or less (0.35 mm thick) is produced by subjecting a high aluminum electromagnetic steel containing not less than 2.5% silicon and not less than 1.0% aluminum to cold-rolling at a high reduction ratio before finishing-annealing and by subjecting the cold-rolled steel sheet or strip to finishing-annealing at a high temperature of 1050° C. or more for a very short period of from 3 to less than 60 seconds.

6 Claims, No Drawings

PROCESS FOR PRODUCING A NON-ORIENTED ELECTROMAGNETIC STEEL SHEET HAVING EXCELLENT MAGNETIC PROPERTIES

TECHNICAL FIELD

The present invention relates to a process for producing a non-oriented electromagnetic steel sheet having excellent magnetic properties. More specifically, the present invention relates to a process for producing a high-grade non-oriented electromagnetic steel sheet of grade S8 or grade S7 which is more excellent than the non-oriented electromagnetic steel sheet of grade S9 presently prescribed in JIS C 2552 as being the most excellent.

BACKGROUND TECHNIQUE

A non-oriented electromagnetic steel sheet of grade S9, which is presently considered to be of the highest grade, is relatively frequently used as the magnetic core material for large-sized rotary machines and the like. High-grade non-oriented electromagnetic steel sheets exhibit a low watt loss, but the magnetic flux density thereof is poor. For this reason, electric companies do not always use high-grade non-oriented electromagnetic steel sheets as the magnetic core material for large-sized rotary machines but instead use grain-oriented silicon steel sheets which have a high magnetic flux density and are expensive.

Recently, it has been considered whether a high-grade non-oriented electromagnetic steel sheet having qualities such that the sheet can be satisfactorily used as the magnetic core material for large-sized rotary machines, while recently the aim being to conserve energy and reduce the cost of production. Therefore, there has been a great demand for a higher-grade non-oriented electromagnetic steel sheet having a lower watt loss and an improved magnetic flux density as compared with the grade S9 non-oriented electromagnetic steel sheet.

The watt loss of a non-oriented electromagnetic steel sheet can be reduced by increasing the silicon or aluminum content in the sheet and by increasing the size of the crystal grains of the product. However, increasing the silicon or aluminum content and increasing the size of the crystal grains by, for example, enhancing the finishing-annealing temperature of a steel strip cause the resultant product to exhibit a decreased magnetic flux density.

Several proposals have been made for producing a high-grade non-oriented electromagnetic steel sheet of grade S7 or grade S8. For example, Japanese Laid-open Patent Application No. 53-66816 discloses a process for producing a non-oriented electromagnetic steel sheet including a so-called double-stage cold-rolling in which a hot-rolled steel sheet is subjected to cold-rolling twice and to intermediate annealing between the first and second cold-rolling steps. In accordance with this process, the sulfur content and the oxygen content in a silicon steel are restricted to trace levels of 0.005% or less and 0.0025% or less, respectively, so as to suppress the formation of fine inclusions in the steel, thereby not hindering crystal growth during annealing; the sheet is subjected to intermediate annealing at a temperature of from 900° C. to 1050° C. for a relatively long period of, for example, from 2 to 15 minutes so as to form large crystal grains having an average grain diameter of 0.07 mm or more; and, the resultant steel having an intermediate sheet thickness is subjected to cold-rolling and is subjected finally to finishing-annealing at a temperature of from 930° C. to 1050° C. for a sufficient period of from 2 to 15 minutes so that the crystal grains have orientations which are desirable for the magnetic flux density of the sheet, thereby improving the magnetic properties of the final product.

However, since this process requires a relatively long period of time (2 to 15 minutes) for both intermediate annealing and final finishing-annealing, internal oxidation of the steel sheet is likely to occur due to the annealing atmosphere, possibly resulting in deterioration of the magnetic properties of the final product. Since internal oxidation of the steel sheet is likely to occur particularly in the final finishing-annealing step, a long annealing period promotes deterioration of the magnetic properties of the final product. Adopting the size of the crystal grains of an intermediate-annealed steel having an intermediate sheet thickness as a criterion in the manufacture of the sheet involves a problem in producing a final product having stable magnetic properties because the crystal grain size cannot be immediately determined during manufacture of the sheet. In addition, this type of criterion makes it impossible to increase the production speed.

Japanese Laid-open Patent Application No. 55-97426 discloses a process for producing a non-oriented electromagnetic steel sheet including single-stage cold-rolling. In accordance with this process, the sulfur content and the nitrogen content is a silicon steel are restricted to not more than 0.005% and not more than 0.004%, respectively, so as to suppress the formation of fine inclusions and precipitates, thereby improving the magnetic properties of the final product; and, in order to prevent internal oxidation of the steel sheet, the hot-rolled steel is subjected to annealing in a non-decarburizing atmosphere and the resultant steel sheet is subjected to finishing-annealing in a non-oxidizing atmosphere or in a decarburizing atmosphere after being coated with a solution of an alkali metal salt at a temperature of from 950° C. to 1100° C. for a period of from 1 to 5 minutes, thereby preventing internal oxidation and thus improving the magnetic properties of the final product. However, it is difficult to produce by means of this process a high-grade non-oriented electromagnetic steel sheet having a stable quality of grade S7 or grade S8, and a non-oriented electromagnetic steel sheet of grade S7 or grade S8 having a stable quality has not yet been produced.

DISCLOSURE OF THE INVENTION

The present inventors made various studies in an attempt to produce a high-grade non-oriented electromagnetic steel sheet having a stable quality of grade S7 or grade S8 at a low cost. As a result, the present inventors discovered that when a high aluminum electromagnetic steel containing 2.5% or more of silicon and 1.0% or more of aluminum is subjected to cold-rolling at a high rolling reduction ratio before finishing-annealing and the cold-rolled steel sheet is subjected to finishing-annealing at a high temperature of 1050° C. or more for a very short period of from 3 to less than 60 seconds, a grade S7 or grade S8 non-oriented electromagnetic steel sheet or strip exhibiting such excellent magnetic properties that the magnetic flux density $B_{50}$ is 1.67 tesla or more, the watt loss $W_{15/15}$ is 2.70 W/kg or less (0.50 mm thick), and the watt loss $W_{15/50}$ is 2.20 W/kg or less (0.35 mm thick) is produced.

The gist of the present invention resides in a process for producing a non-oriented electromagnetic steel sheet having excellent magnetic properties, wherein a steel slab for producing a non-oriented electromagnetic steel sheet containing not more than 0.005% carbon, not less than 2.5% silicon, not less than 1.0% aluminum, the total content of silicon and aluminum being from 3.5% to 5.0%, not more than 0.005% sulfur, and not more than 0.0040% nitrogen is hot-rolled followed by hot-coil annealing, a final sheet thickness is obtained by cold-rolling the sheet once or twice or more, and intermediate annealing between cold rolling steps and finishing-annealing are carried out, characterized in that cold-rolling before finishing-annealing is carried out at a reduction ratio of from 55% to 87% and in that finishing-annealing is carried out by realizing a holding temperature of 1050° C. or more for a period of from 3 to less than 60 seconds.

Also, the present invention is characterized by temperature elevating from 400° C. to 800° C. at an average rate of temperature elevation of at least 10° C./sec in the finishing-annealing step.

Moreover, the present invention is characterized by carrying out stepwise soaking within a short period by realizing a soaking temperature of from 850° C. to 1000° C. for a period of from 30 to 120 seconds prior to holding at temperature of 1050° C. or more for a period of from 3 to 60 seconds.

The present invention is described in detail below, first with reference to the ingredients and composition of a steel slab.

Carbon is an element which deteriorates the magnetic properties of a non-oriented electromagnetic steel sheet. A carbon content exceeding 0.005% in a steel slab results in the precipitation of carbides which cause the final product to exhibit an increased watt loss and a decreased magnetic flux density. Therefore, the maximum carbon content of a steel slab should be 0.005%. The carbon content is preferably 0.003% or less in view of enhancement of the magnetic properties of the final product. Although decarburization is conventionally carried out during the annealing step to reduce the carbon content, a steel containing large amounts of silicon and aluminum is likely to be internally oxidized during decarburization annealing, with the result that the final product exhibits deteriorated magnetic properties. Therefore, in the present invention having the aim of producing a high-grade electromagnetic steel sheet decarburization is carried out in the melting step so as to provide a steel slab containing not more than 0.005% carbon.

Silicon is an effective element for increasing the electric resistance of the final product so as to decrease the eddy-current loss thereof, thereby reducing the watt loss thereof. Therefore, the silicon content of a steel should be at least 2.5%. However, the cold-rolling workability of the steel sheet becomes inferior with an increase in the silicon content. Therefore, the total content of aluminum, which is described hereinafter, and silicon should be not more than 5.0%. The lower limit of the total content of silicon and aluminum should be 3.5% in order to ensure that the final product has an excellent watt loss characteristic.

Aluminum is an effective element for reducing the watt loss of the final product, as is silicon, and is simultaneously effective for fixing the nitrogen contained in a steel in a harmless form so as to improve the magnetic properties of the final product. The present inventors discovered that when a steel sheet containing an increased amount of aluminum is cold-rolled at a high reduction ratio before finishing-annealing and the cold-rolled sheet is subjected to finishing-annealing in which a holding temperature at a high temperature of 1050° C. or more for a short period of from 3 seconds to less than 60 seconds is realized, the size of the crystal grains of the steel sheet is stably increased and the resultant final product exhibits a low watt loss and an excellent magnetic flux density. In order to obtain this effect, the aluminum content should be at least 1.0%. Also, the above-mentioned effect of aluminum can be intensified when the rate of temperature elevation during finishing-annealing is increased to 10° C./sec or more.

The function and the effect of aluminum are described below with reference to one experimental example wherein aluminum was used in an amount of 1.0% or more.

As specimens, Sample A containing 1.20% aluminum and Sample B containing 0.05% aluminum, both of which has almost the same total content of silicon and aluminum (about 3.9%), as can be seen from Table 1, were used. These samples were subjected to the production processes indicated in Table 2.

TABLE 1

| Sample | Ingredients of Slab (%) | | | | | |
|---|---|---|---|---|---|---|
| | C | Si | Al | Si + Al | S | N |
| A | 0.003 | 2.71 | 1.20 | 3.91 | 0.003 | 0.0021 |
| B | 0.003 | 3.24 | 0.65 | 3.89 | 0.002 | 0.0025 |

TABLE 2

Slab-Heating Condition → Hot-Rolling → Cold-Rolling → Annealing → Cold-Rolling → Annealing

| | | | |
|---|---|---|---|
| 1100° C. × 1 hr and 1200° C. × 1 hr | (2.7 mm) (1.7 mm) 980° C. (0.5 mm) | | |
| | 1075° C. × 10 sec | | |
| | 2 min | | N 70% |
| | $N_2$ dry | | H 30% |
| | | | dry |

The magnetic properties of Samples A and B are shown in Table 3.

TABLE 3

| Slab-Heating Condition | Sample A | | | Sample B | | |
|---|---|---|---|---|---|---|
| | $B_{50}$ (tesla) | $W_{10/50}$ (W/kg) | $W_{15/50}$ (W/kg) | $B_{50}$ (tesla) | $W_{10/50}$ (W/kg) | $W_{15/50}$ (W/kg) |
| 1100° C. × 1 hr | 1.707 | 1.03 | 2.43 | 1.697 | 1.17 | 2.71 |
| 1200° C. × 1 hr | 1.703 | 1.08 | 2.50 | 1.691 | 1.24 | 2.88 |

As Table 3 shows, Sample A containing 1.2% aluminum exhibited a more excellent watt loss $W_{10/50}$, watt loss $W_{15/50}$, and magnetic flux density $B_{50}$ than did Sample B containing 0.65% aluminum. As Table 3 also shows, when the slab-heating temperature was changed by 100° C., the change in the magnetic properties of Sample A was smaller than that of Sample B, indicating that even if the total of content of silicon and aluminum is maintained, a larger aluminum content of 1.0% or more imparts to the final product more excellent and stable magnetic properties.

An aluminum content of 1.0% or more is also effective for eliminating the adverse effects of titanium, zinconium, chromium, vanadium and the like, contained as tramp elements in a steel, on the magnetic properties of a non-oriented electromagnetic steel sheet.

Sulfur forms fine sulfides which cause the resultant product to have a deteriorated watt loss. Therefore, the maximum sulfur content in a steel should be 0.005%, preferably 0.003% or less.

Nitrogen serves to deteriorate the magnetic properties of a non-oriented electromagnetic steel sheet. Therefore, the nitrogen content of a steel should be 0.0040% or less, preferably 0.0025% or less.

Manganese is an element which is not particularly controlled in the present invention. However, when the manganese content is less than 0.1%, the hot workability of steel becomes poor, and when the manganese content is more than 1.0%, a non-oriented electromagnetic steel sheet exhibits deteriorated magnetic properties. Therefore, the manganese content is preferably in the range of from 0.1% to 1.0%.

The starting material usable for the present invention may be any steel containing the above-mentioned ingredients within the above-specified ranges. The steel of the present invention can be produced by means of a conventional melting process and an ingot-making process. A slab produced by an ingot-making and an ingot-rolling process or continuous casting or a slab produced by subjecting a continuously cast slab to rolling can be used as the slab for the present invention.

The production process of the present invention is described below.

A steel slab is heated to a temperature in the range of from 1050° C. to 1250° C. and is then hot-rolled to reduce the thickness thereof, for example, from 1.5 to 3.0 mm. Subsequently, hot-coil annealing and cold-rolling are carried out once to obtain a final sheet thickness, and finishing-annealing are carried out (Process 1). Alternatively, cold-rolling is carried out twice so as to obtain a final sheet thickness, intermediate-annealing is carried out between the cold rolling steps, and then finishing-annealing is carried out (Process 2).

Either Process 1 or Process 2 may be optionally selected. It is preferable that if Process 1 be adopted a hot-rolled sheet has a small thickness of, for example, 2 mm or less and that Process 2 be adopted if a hot-rolled sheet has a large thickness.

The reduction ratio of cold-rolling is described below.

In the case of Process 2, the reduction ratio of the first cold-rolling is not limited to any special value. In Processes 1 and 2 when the steel sheet to be cold-rolled contains not less than 1.0% aluminum and not less than 3.5%, particularly not less than 4.0%, of the total content of aluminum and silicon, the magnetic properties of the final product can be enhanced by selecting any suitable combination of finishing-annealing and a cold-rolling reduction ratio before finishing-annealing. For this purpose, the reduction ratio of final cold-rolling should be in the range of from 55% to 87%. If the reduction ratio is less than 55% or more than 87% when the total content of silicon and aluminum is 3.6% or more, a final product exhibiting excellent magnetic properties cannot be obtained. Also, if the reduction ratio exceeds 87%, the steel sheet to be cold-rolled must have a large thickness, with the result that edge cracking and fracture may occur during cold-rolling. Therefore, the upper limit of the reduction ratio should be 87%.

The relationship between a combination of the reduction ratio of final cold-rolling and the finishing-annealing temperature and the magnetic properties of the final product is described below by means of experimental examples.

Nineteen hot-rolled steel sheets containing not more than 0.005% carbon, from 0.20 to 0.25% manganese, not more than 0.005% sulfur, from 0.0020 to 0.0025% nitrogen, from 2.51 to 3.56% silicon, and from 1.02 to 1.97% aluminum, the total content of silicon and aluminum being from 3.53% to 4.86%, were treated under the conditions indicated in Table 4.

TABLE 4

| Division of Process Condition | Thickness of Hot-rolled Sheet | | Cold-Rolling | | Annealing | | Final Cold-Rolling (Reduction Ratio) | | Finishing-Annealing |
|---|---|---|---|---|---|---|---|---|---|
| Ⓐ | 2.7~3.0 mm | → | 1.2 mm | → | 950° C. × 60″ | → | 0.35 (71%) | → | 1075° C. × 10″ |
| Ⓑ | 2.7~3.0 | → | 1.2 | → | 950° C. × 60″ | → | 0.35 (71%) | → | 950° C. × 90″ |
| Ⓒ | 2.7~3.0 | → | 0.7 | → | 950° C. × 60″ | → | 0.35 (50%) | → | 1075° C. × 10″ |
| Ⓓ | 2.7~3.0 | → | 0.7 | → | 950° C. × 60″ $N_2$ dry | → | 0.35 (50%) | → | 950° C. × 90″ N 70% dry H 30% dry |

The magnetic properties ($W_{10/50}$, $W_{15/50}$, and $B_{50}$) of the products were determined by means of a simple magnetometric instrument (SST) to investigate the dependence thereof on the total content of silicon and aluminum. The rates of change in the magnetic properties per 1% variation in the total content of silicon and aluminum are shown in Table 5.

TABLE 5

| Division of Process Condition | Percentage of Decrease in $B_{50}$ (tesla) | Percentage of Increase in $W_{10/50}$ (W/kg) | Percentage of Increase in $W_{15/50}$ (W/kg) |
|---|---|---|---|
| Ⓐ | 0.0185 | 0.095 | 0.24 |
| Ⓑ | 0.0168 | 0.097 | 0.19 |
| Ⓒ | 0.0287 | 0.050 | 0.18 |
| Ⓓ | 0.0274 | 0.016 (deteriorated) | 0.024 |

As is apparent from Table 5, Condition Ⓐ in which the reduction ratio of final cold-rolling was high and finishing-annealing was carried out at a high temperature for a short period of time is preferable for the treatment of a hot-rolled sheet having a high content of silicon and aluminum. Particularly, Condition Ⓐ is characterized by a high percentage of increase in watt loss at a high magnetic field, i.e. $W_{15/50}$.

It is preferable that finishing-annealing be carried out by realizing a high holding temperature of 1050° C. or more for a short period of from 3 to less than 60 seconds. When the holding temperature is less than 1050° C., the reduction ratio of the watt loss of the final product is not appreciable. When the holding time is less than 3 seconds, the reduction ratio of the watt loss of the final product is also not appreciable. Also, a holding time exceeding 60 seconds may cause internal oxidation of the steel sheet, resulting in an increase in the watt loss of a non-oriented steel sheet and a deterioration in the magnetic flux density thereof. For these reasons, finishing-annealing should be carried out under the above-specified conditions. A preferable holding time is in the range of from 3 to 40 seconds, and preferable holding temperature is in the range of from 1050° C. to 1100° C.

Increasing the rate of temperature elevation in the finishing-annealing step is advantageous for ensuring that the final product has an excellent magnetic flux density. An average rate of temperature elevation of at least 10° C./sec, preferably at least 30° C./sec, in heating from 400° C. to 800° C. provides good results.

Also, when in finishing-annealing brief stepwise soaking is carried out at a temperature of from 850° C. to 1000° C. for a period of from 30 to 120 seconds before being carried out at a holding temperature of 1050° C. or more for a period of from 3 to less than 60 seconds, the resultant final product exhibits excellent magnetic properties.

The atmosphere in an annealing furnace also is an important factor in regard to the magnetic properties, particularly these at a high magnetic field, of the final product. Particularly, when the total content of silicon and aluminum in a steel is high, even the use of a weak-oxidizing decarburizing atmosphere having a ratio of the partial pressure of water vapor to the partial pressure, $P_{H_2O}/P_{H_2}$, of from approximately 0.1 to 0.4 involves a problem in that the silicon and aluminum are selectively oxidized, whereby the internally oxidized layer is increased. Therefore, in the present invention a decarburization treatment is previously satisfactorily effected in the melting step so as to reduce the carbon content of the molten steel to not more than 0.005%, preferably not more than 0.003%, and no intentional decarburization treatment is effected in the annealing step. Accordingly, for example, a non-decarburizing atmosphere composed of dry $N_2$ gas or a dry gas consisting of 70% $N_2$ and 30% $H_2$ and having a dew point of 0° C. or less is used as the annealing atmosphere. Particularly, in the finishing-annealing step, the use of an atmosphere containing approximately 20% or more of hydrogen provides better results.

BEST MODE FOR THE PRACTICE OF THE INVENTION

Example 1

Molten steel melted in a converter was subjected to a degassing treatment by using a DH degassing device and the degassed molten steel was decarburized. After alloying elements were added to the decarburized molten steel, the resultant molten steel was subjected to continuous casting to obtain a slab. The resultant steel slab consisted of 0.0026% C, 3.02% Si, 1.31% Al, 0.0020% S, 0.0018% N, and 0.21% Mn, the remainder consisting of iron and unavoidable impurities.

The steel slab having the above-mentioned composition was heated to a temperature of 1150° C., followed by hot-rolling to obtain a 1.8 mm-thick hot-rolled sheet. The hot-rolled sheet was annealed in an atmosphere of dry $N_2$ at a temperature of 980° C. for 120 seconds, was pickled, and then was cold-rolled so as to reduce the thickness to 0.5 mm. The cold-rolled steel sheet was subjected to finishing-annealing in an atmosphere composed of a dry gas consisting of 70% dry $N_2$ and 30% $H_2$ at a temperature of 950° C. for 90 seconds or at a temperature of 1075° C. for 10 seconds. During the finishing-annealing step, the rates of temperature elevation from 400° C. to 800° C. were 18° C./sec and 33° C./sec, respectively. The magnetic properties of the resultant products are shown in Table 6. The product subjected to finishing-annealing at 1075° C. for 10 seconds exhibited a high magnetic flux density $B_{50}$ which was equivalent to that of a non-oriented electromagnetic steel sheet of grade S7.

TABLE 6

| Finishing-Annealing | $W_{10/50}$ (W/kg) | $W_{15/50}$ (W/kg) | $B_{50}$ (tesla) |
|---|---|---|---|
| 1075° C. × 10 seconds | 1.02 | 2.38 | 1.69 |
| 950° C. × 90 seconds | 1.10 | 2.58 | 1.65 |

Example 2

Molten steel prepared in a converter was subjected to a vacuum treatment by using a DH degassing device so as to carry out decarburization and to add alloying elements. The molten steel having an adjusted steel chemistry was subjected to continuous casting to obtain a slab. In this manner, two types of steel slabs each having the composition indicated in Table 7 were produced.

TABLE 7

| | Ingredients (%) | | | | | | |
|---|---|---|---|---|---|---|---|
| Sample | C | Si | Mn | S | Al | N | Si + Al |
| 1 | 0.0024 | 3.16 | 0.21 | 0.003 | 1.35 | 0.0016 | 4.51 |
| 2 | 0.0026 | 3.17 | 0.20 | 0.003 | 0.52 | 0.0022 | 3.69 |

These steel slabs were heated to a temperature of 1150° C., followed by hot-rolling to obtain 2.5 mm-thick hot-rolled steel sheets. The hot-rolled steel strips were pickled and then were cold-rolled to obtain two types of cold-rolled strips having a thickness of 0.7 mm and 1.2 mm, respectively. These steel strips were intermediate-annealed in an atmosphere of dry $N_2$ at a temperature of 950° C. for 120 seconds, followed by cold-rolling to obtain cold-rolled strips having a final thickness of 0.35 mm. The cold-rolled steel strips were subjected to finishing-annealing at a temperature of 1075° C. for 10 seconds by using a rate of temperature elevation of 33° C./sec from 400° C. to 800° C. The annealing atmosphere was composed of a dry gas consisting of 70% $N_2$ and 30% $H_2$. The magnetic properties of the products obtained after finishing-annealing are indicated in Table 8.

TABLE 8

| | Intermediate thickness (Final Reduction ratio) | Finishing-Annealing | Sample 1 $W_{10/50}$ (W/kg) | Sample 1 $W_{15/50}$ (W/kg) | Sample 1 $B_{50}$ (tesla) | Sample 2 $W_{10/50}$ (W/kg) | Sample 2 $W_{15/50}$ (W/kg) | Sample 2 $B_{50}$ (tesla) |
|---|---|---|---|---|---|---|---|---|
| Condition E | 1.2 (71%) | 1075° C. × 10″ | 0.87 | 1.94 | 1.685 | 0.95 | 2.22 | 1.700 |

TABLE 8-continued

| | Intermediate thickness (Final Reduction ratio) | Finishing-Annealing | Sample 1 $W_{10/50}$ (W/kg) | Sample 1 $W_{15/50}$ (W/kg) | Sample 1 $B_{50}$ (tesla) | Sample 2 $W_{10/50}$ (W/kg) | Sample 2 $W_{15/50}$ (W/kg) | Sample 2 $B_{50}$ (tesla) |
|---|---|---|---|---|---|---|---|---|
| Condition F | 0.7 (50%) | 1075° C. × 10" | 0.90 | 2.12 | 1.665 | 0.96 | 2.27 | 1.705 |

As is apparent from the results shown in Table 8, the product corresponding to Sample 1, which was prepared according to the present invention by using Condition E, was more excellent in respect to both watt loss $W_{15/50}$ at a high magnetic field and watt loss $W_{10/50}$ at a low magnetic field than were the other products.

Example 3

Molten steel prepared in a converter was subjected to a vacuum treatment by using a DH degassing device so as to carry out decarburization and to add alloying elements. The resultant molten steel having an adjusted steel chemistry was subjected to continuous casting to produce a steel slab. The resultant steel slab consisted of 0.0028% C, 2.75% Si, 0.22% Mn, 0.002% S, and 1.22% Al, the remainder consisting of iron and unavoidable impurities.

The steel slab was heated to a temperature of 1200° C., followed by hot-rolling to obtain a 1.8 mm-thick hot-rolled strip. The hot-rolled steel strip was annealed in an atmosphere of dry $N_2$ at a temperature of 980° C. for 120 seconds and was cold-rolled to obtain a 0.35 mm-thick cold-rolled strip. The cold-rolled steel strip was subjected to finishing-annealing in an atmosphere composed of a dry gas consisting of 70% $N_2$ and 30% $H_2$ under the three conditions indicated in Table 9. (Condition G is a two-stage temperature holding method)

TABLE 9

| | Condition | Rate of Temperature Elevation from 400° C. to 800° C. | Soaking (1) | Soaking (2), Subsequent to Soaking (1) |
|---|---|---|---|---|
| Present Invention | Condition G | 17° C./sec | 925° C. × 40 sec | 1075° C. × 10 sec |
| Present Invention | Condition H | 33° C./sec | 1075° C. × 10 sec | — |
| Comparative Example | Condition I | 34° C./sec | 1075° C. × 90 sec | — |

The magnetic properties of the products obtained after finishing-annealing are shown in Table 10 below.

TABLE 10

| | | $W_{10/50}$ (W/kg) | $W_{15/50}$ (W/kg) | $B_{50}$ (tesla) |
|---|---|---|---|---|
| Present Invention | Condition G | 0.86 | 1.99 | 1.69 |
| Present Invention | Condition H | 0.83 | 1.92 | 1.72 |
| Comparative Example | Condition I | 0.92 | 2.15 | 1.65 |

As is apparent from the results shown in Table 10, in accordance with the present invention, a steel strip exhibiting excellent magnetic properties both at a high magnetic field and at a low magnetic field can be produced.

INDUSTRIAL UTILITY

The process of the present invention can be utilized in the steel industry to produce at a low cost an electromagnetic steel sheet or strip having excellent magnetic properties.

We claim:

1. A process for producing a non-oriented electromagnetic steel sheet having excellent magnetic properties, wherein a steel slab for producing a non-oriented electromagnetic steel sheet is successively subjected to the steps comprising:

hot-rolling steel consisting essentially of not more than 0.005% carbon, not less than 2.5% silicon, not less than 1.0% aluminum, the total content of silicon and aluminum being from 3.5% to 5.0%, not more than 0.005% sulfur, and not more than 0.0040% nitrogen, the balance being iron;

hot-coil annealing;

single-stage cold-rolling at a final reduction of from 55% to 87% to obtain a thickness of said non-oriented electrical steel sheet; and finishing annealing, in which a soaking is carried out at a temperature of 1050° C. or more for a period of from 3 to less than 60 seconds, and wherein heating from 400° C. to 800° C. in finishing annealing is carried out at an average rate of temperature elevation of at least 10° C./sec.

2. A process according to claim 1, wherein in finishing-annealing brief stepwise soaking is carried out at a temperature of from 850° C. to 1000° C. for a period of from 30 to 120 seconds prior to being carried out at a holding temperature of 1050° C. or more for a period of from 3 to less than 60 seconds.

3. A process according to claim 1, wherein finishing-annealing is carried out in a non-decarburizing atmosphere.

4. A process for producing a non-oriented electromagnetic steel sheet having excellent magnetic properties, wherein a steel slab for producing a non-oriented electromagnetic steel sheet is successively subjected to the steps comprising:

hot-rolling steel consisting essentially of not more than 0.005% carbon, not less than 2.5% silicon, not less than 1.0% aluminum, the total content of silicon and aluminum being from 3.5% to 5.0%, not more than 0.005% sulfur, and not more than 0.0040% nitrogen, the balance being iron;

hot-coil annealing;

multi-stage cold-rolling with an intermediate annealing, at a final reduction of from 55% to 87% to obtain a thickness of said non-oriented electrical steel sheet; and finishing annealing, in which a soaking is carried out at a temperature of 1050° C. or more for a period of from 3 to less than 60 seconds, and wherein heating from 400° C. to 800° C. in finishing annealing is carried out at an average rate of temperature elevation of at least 10° C./sec.

5. A process according to claim 4, wherein in finishing-annealing brief stepwise soaking is carried out at a temperature of from 850° C. to 1000° C. for a period of from 30 to 120 seconds prior to being carried out at a holding temperature of 1050° C. or more for a period of from 3 to less than 60 seconds.

6. A process according to claim 4, wherein finishing-annealing is carried out in a non-decarburizing atmosphere.

* * * * *